US007096519B2

(12) United States Patent
Ferreri et al.

(10) Patent No.: US 7,096,519 B2
(45) Date of Patent: Aug. 29, 2006

(54) SHELF FOR SHOWER ENCLOSURE

(75) Inventors: Susan Ferreri, 2312 Bristol Dr., Carrollton, TX (US) 75006; William K. Hunter, Midlothian, TX (US)

(73) Assignee: Susan Ferreri, Carrollton, TX (US)

( * ) Notice: Subject to any disclaimer, the term of this patent is extended or adjusted under 35 U.S.C. 154(b) by 0 days.

(21) Appl. No.: 10/411,068

(22) Filed: Apr. 9, 2003

(65) Prior Publication Data

US 2004/0003459 A1 Jan. 8, 2004

Related U.S. Application Data

(60) Provisional application No. 60/387,167, filed on Jun. 7, 2002.

(51) Int. Cl.
*A47K 3/22* (2006.01)

(52) U.S. Cl. ..... 4/596; 4/605; 4/559; 4/661

(58) Field of Classification Search ..... 4/559, 4/605, 661, 576, 607, 546; 248/215, 340, 248/304; 47/67, 68, 40
See application file for complete search history.

(56) References Cited

U.S. PATENT DOCUMENTS 519,879 A * 5/1894 Stevens, Jr. ..... 4/678
2,997,722 A * 8/1961 Person ..... 4/678
3,591,867 A * 7/1971 Bernstein ..... 4/579
4,559,738 A * 12/1985 Helfman ..... 47/67
4,640,045 A * 2/1987 Nesbitt et al. ..... 47/67
D288,998 S * 3/1987 Wiggins ..... D6/524
4,698,936 A * 10/1987 Helfman ..... 47/68
D315,653 S * 3/1991 Truffa ..... D6/524
5,079,872 A * 1/1992 Short ..... 4/607
5,181,621 A * 1/1993 Plaehn ..... 4/559
5,368,266 A * 11/1994 Allen ..... 248/231.41
5,664,367 A * 9/1997 Huang ..... 47/40
6,698,602 B1 * 3/2004 Taylor ..... 211/74

* cited by examiner

*Primary Examiner*—Khoa D. Huynh
(74) *Attorney, Agent, or Firm*—Jack D. Stone, Jr.

(57) ABSTRACT

A decorative accessory for tub and shower enclosures comprises a shelf extending along the top of a tub and shower enclosure for supporting potted plants, decorative pots and accessories, and other decorative items. The shelf comprises a plurality of transversely extending brackets and a plurality of longitudinally extending slats which are separated by slots to facilitate drainage. In the case of a tub and shower enclosure having a head piece the shelf is supported thereon by slots formed in the bottom of the bracket which engage the head piece. In the case of a tub and shower enclosure comprising a shower curtain and a shower curtain support rod, the shower curtain support rod and the rings which support the shower curtain therefrom extend through the slot formed in the bottoms of the brackets of the shelf.

18 Claims, 11 Drawing Sheets

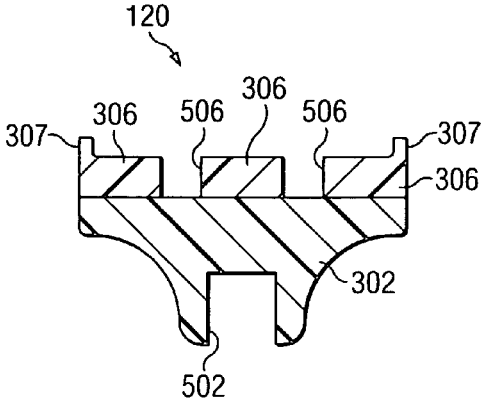
FIG. 5
FIG. 6
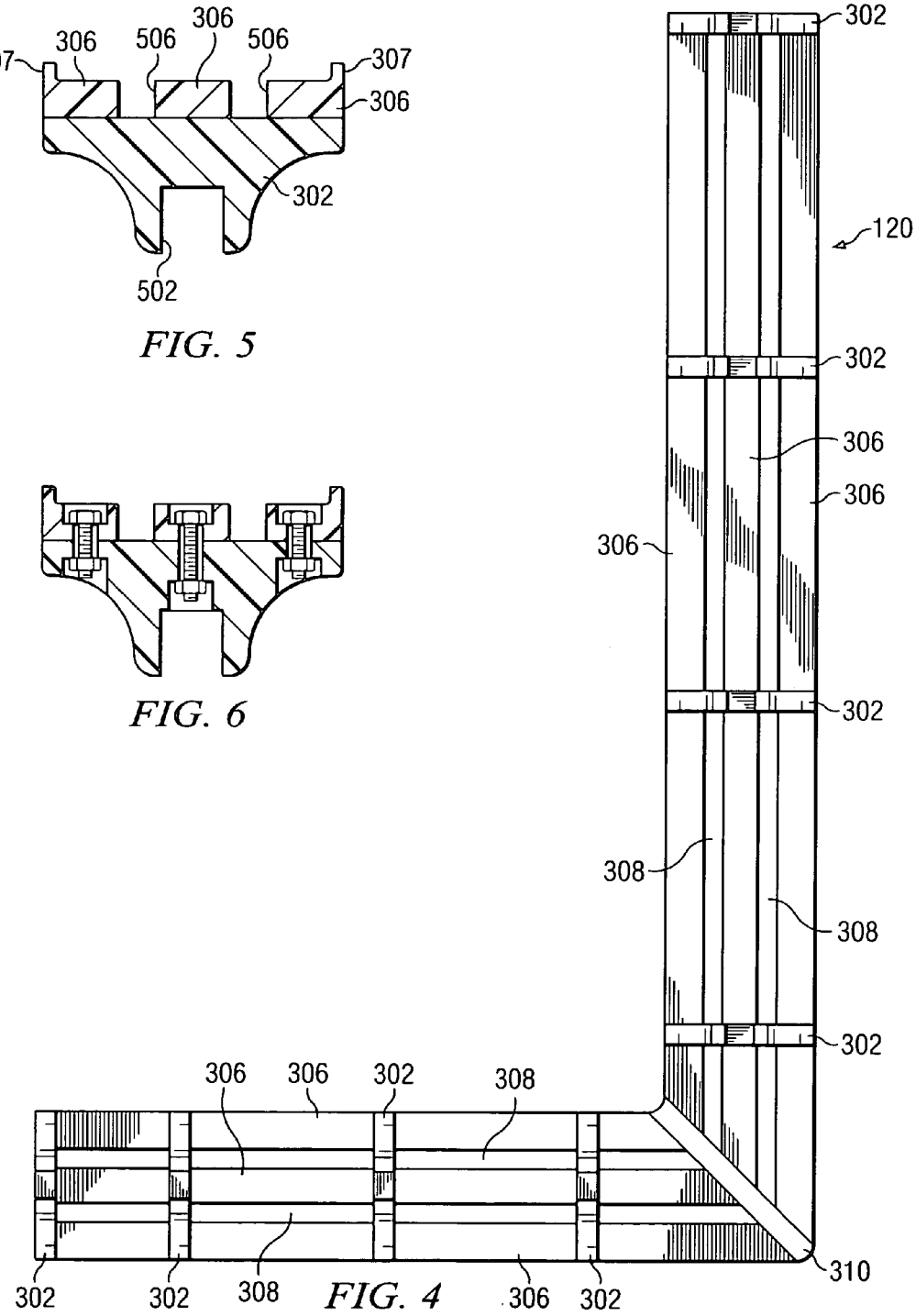
FIG. 4

FIG. 11
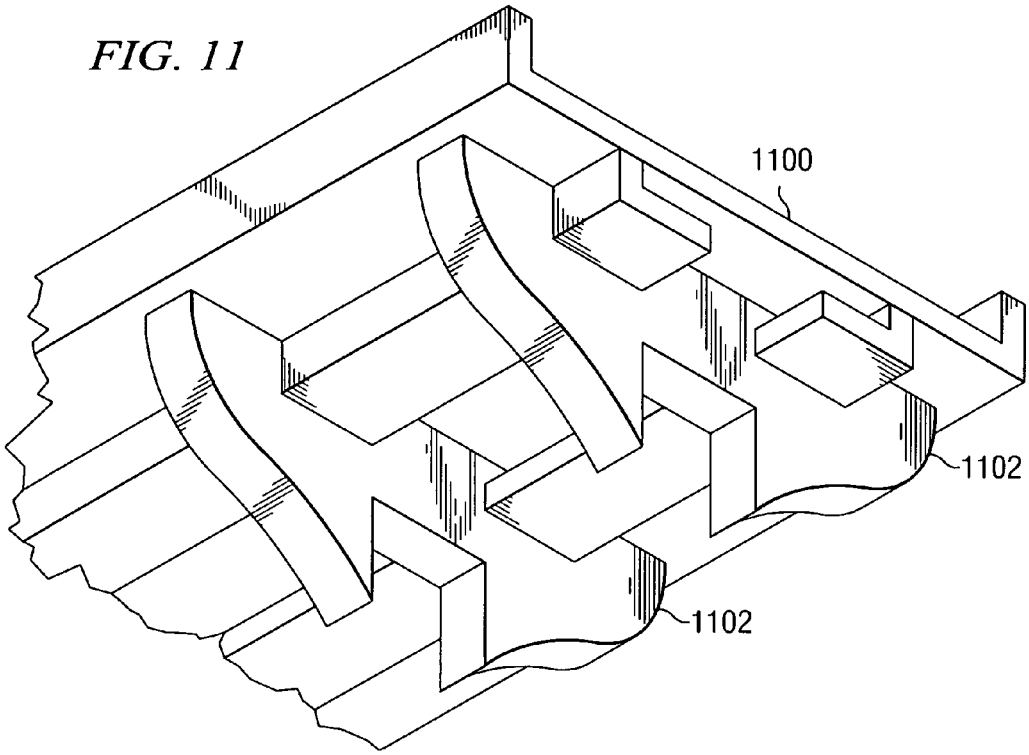
FIG. 12
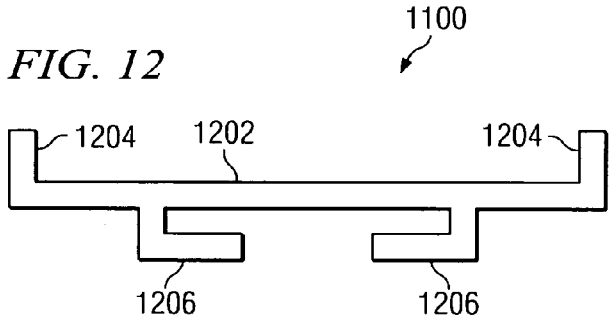
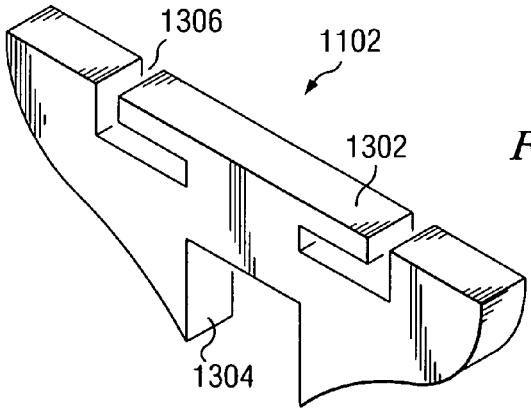
FIG. 13

SHELF FOR SHOWER ENCLOSURE

CLAIM OF PRIORITY

This application claims priority from U.S. Provisional Patent Application No. 60/387,167 entitled "DECORATIVE ACCESSORY FOR TUB AND SHOWER ENCLOSURES" filed on behalf of Susan Ferreri, on Jun. 7, 2002.

TECHNICAL FIELD

This invention relates generally to an accessory adaptable for tub and shower enclosures of the type typically utilized in homes and apartments, and more particularly, to a shelf extending along an upper edge and/or side of a tub and/or shower enclosure, the shelf being configured for supporting decorative items, such as potted plants, decorative pots and statuary, and the like, as well as items usable while in a tub or shower, such as soap, shampoo, towels, toiletries, and the like.

BACKGROUND

Modern homes and apartments are typically provided with bathing facilities comprising a tub, a shower, or a combination thereof. In most instances the bathing facility is provided with an enclosure which prevents spray from the shower from escaping and possibly damaging the surrounding floor and walls. Heretofore, tub and shower enclosures have typically been undecorated, and have therefore been relatively utilitarian in appearance. Tub and shower enclosures, furthermore, typically lack sufficient provision for placement of items that may be used in a shower, but which should preferably remain dry, until needed, such as extra bars of soap, razors, towels, toiletries and the like.

Therefore, what is needed is a decorative accessory adaptable for use with a tub and shower, which accessory also provides for placement of items useable in connection with a shower, but which would preferably remain dry, at least until needed.

SUMMARY

In accordance with the present invention there is provided a shelf which extends along the upper edge of a shower enclosure. In use, the shelf of the present invention provides a support for potted plants, decorative pots and statuary, and other decorative items. In a typical application a potted plant such as ivy or philadendrum is supported on the shelf thereby providing a pleasing appearance which has heretofore been unobtainable. It has been found that the moist atmosphere characteristic of bathing facilities is highly conducive to the health of potted plants supported on the shelf of the present invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 4 is a bottom view of the shelf of FIG. 1;

FIG. 5 is a cross-sectional view taken along the line 5—5 in FIG. 3;

FIGS. 6 and 7 are cross-sectional views of alternate embodiments of FIG. 5;

FIGS. 11–13 show an alternate embodiment of the present invention in which a shelf is slidably mounted on brackets;

DETAILED DESCRIPTION

Figure 1:
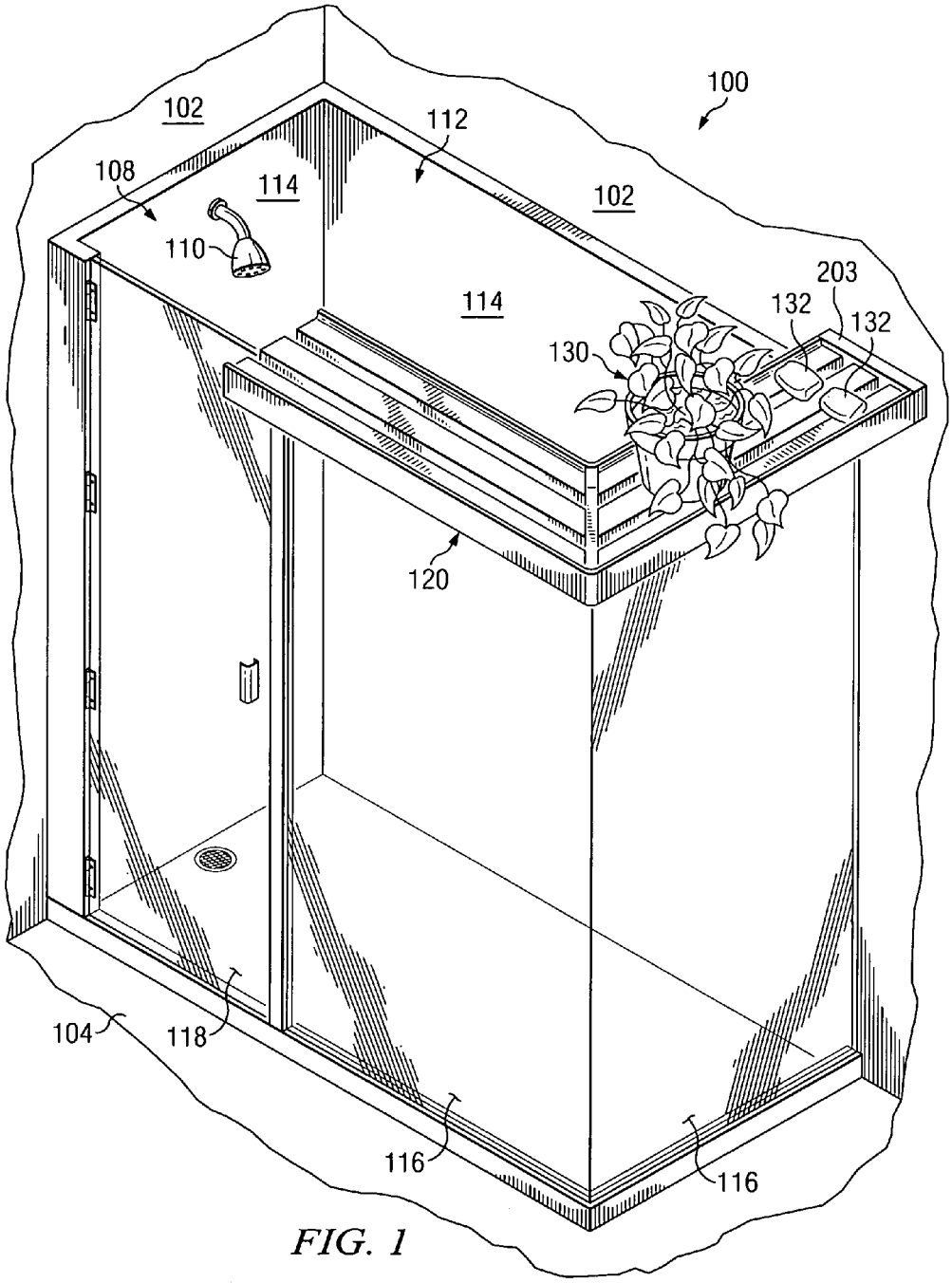
FIG. 1 is a perspective view of a tub and shower enclosure having mounted thereon a shelf embodying features of the present invention.

In the following discussion, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning tubs, showers, and the like have been omitted inasmuch as such details are not considered necessary to obtain a complete understanding of the present invention, and are considered to be within the skills of persons of ordinary skill in the relevant art.

Refer now to the drawings wherein depicted elements are, for the sake of clarity, not necessarily shown to scale and wherein like or similar elements are designated by the same reference numeral through the several views.

In FIG. 1 of the drawings, the reference numeral 100 generally designates a room comprising walls 102 and a floor 104. A bathing facility 108 is installed in the room 100 and preferably includes a shower head 110 and, optionally, may also include a bathtub (also referred to simply as a "tub," not shown). A shower enclosure 112 surrounds the bathing facility 108. It is noted that the term "shower enclosure" is used generically herein to include a shower enclosure, a tub, a combination thereof, and/or the like. The shower enclosure 112 includes substantially waterproof walls 114 secured to the walls 102 of the room 100, and substantially waterproof freestanding walls 116 extending from the walls 114. A door 118 provides access to the bathing facility 108. The freestanding walls 116 and door 118 define upper edges 117 and 119, respectively, which preferably do not extend to a ceiling (not shown) of the room 100. The upper edges 117 and 119 may optionally be fitted with headpieces or molding (not shown) which extend along the upper edges.

Figure 2:
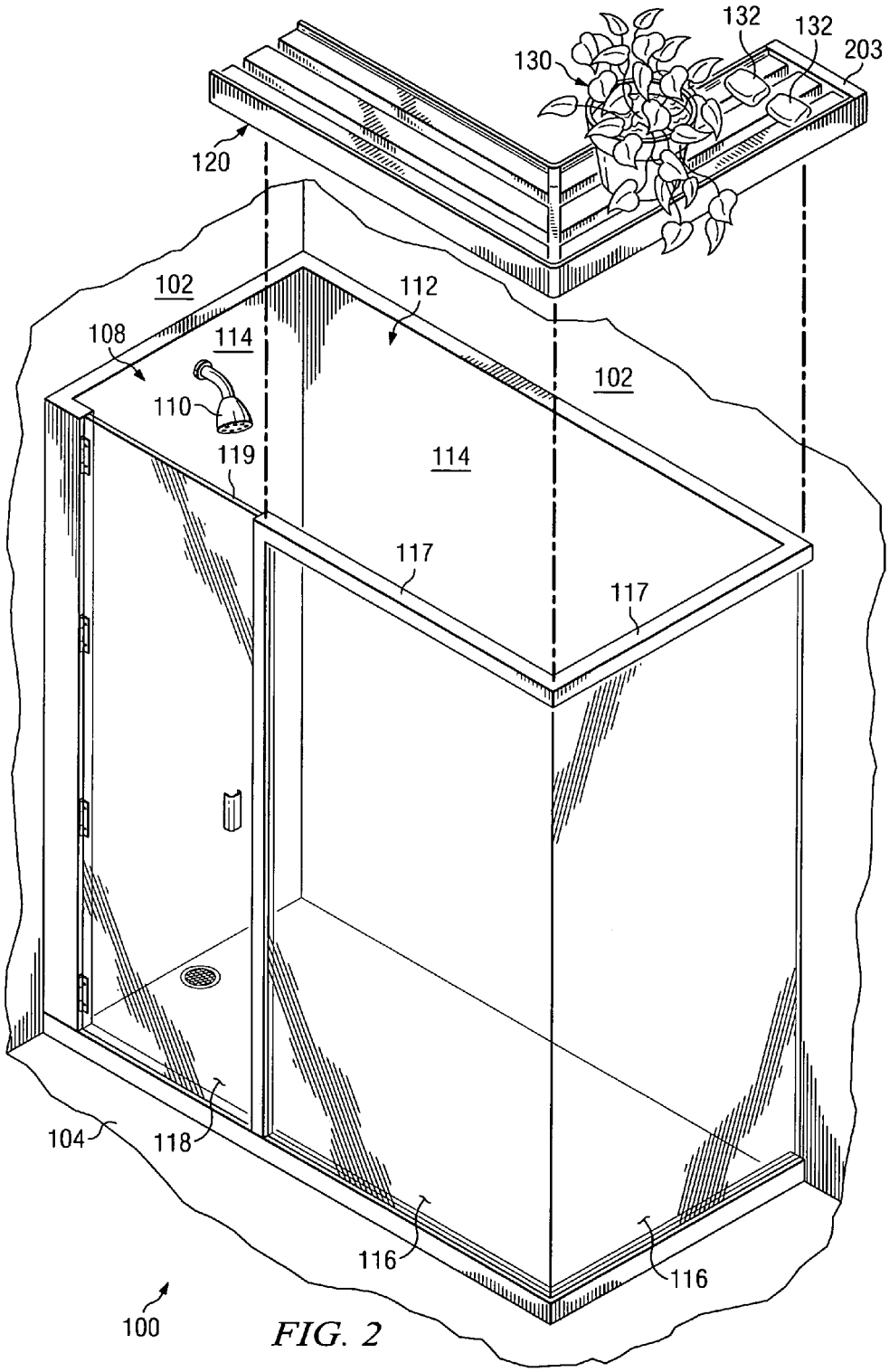
FIG. 2 is an exploded view of FIG. 1.

In accordance with principles of the present invention, and as described in further detail below, a decorative accessory for shower enclosures comprises a shelf 120 extending along the upper edges 117 and 119 of the shower enclosure 112. As exemplified in FIGS. 3 and 4, the shelf 120 comprises a plurality of slats 306, three of which are shown extending longitudinally in each of two orthogonal directions across spaced transversely extending brackets 302. The slats 306 are spaced apart to define slots 308 between the slats 306 for facilitating drainage. Outer slats 306 include lips 307 for retaining items placed on the shelf 120. While the slats 306 are depicted in FIGS. 1–3 as being straight, they may optionally be curvilinear, or customized or shaped to fit any of a number of different shower enclosure configurations.

As viewed in FIG. 5, the brackets 302 have slots 502 formed in the lower portions thereof. The slots 502 are preferably sized for matingly engaging with and receiving the upper edges 117 and 119 (or headpieces fitted thereon) of the walls 116 and 118, respectively, and to support the shelf 120 thereon. The slats 306 are positioned on the brackets 302 and secured thereto via, by way of example, adhesive, hook-and-loop material, and/or the like. Alternatively, as shown in FIG. 6, holes 602 and 604 may be formed in the brackets 302 and slats 306, and conventional mechanical fasteners, such as bolts 606, extended therethrough for securing the slats thereto. The bolt 606 may be secured in place via conventional nuts or by threadingly engaging one of the holes 602 or 604. One of the holes 602 or 604 may furthermore be oversized to allow for adjustment of the shelf 120 on the brackets 302.

Figure 3:
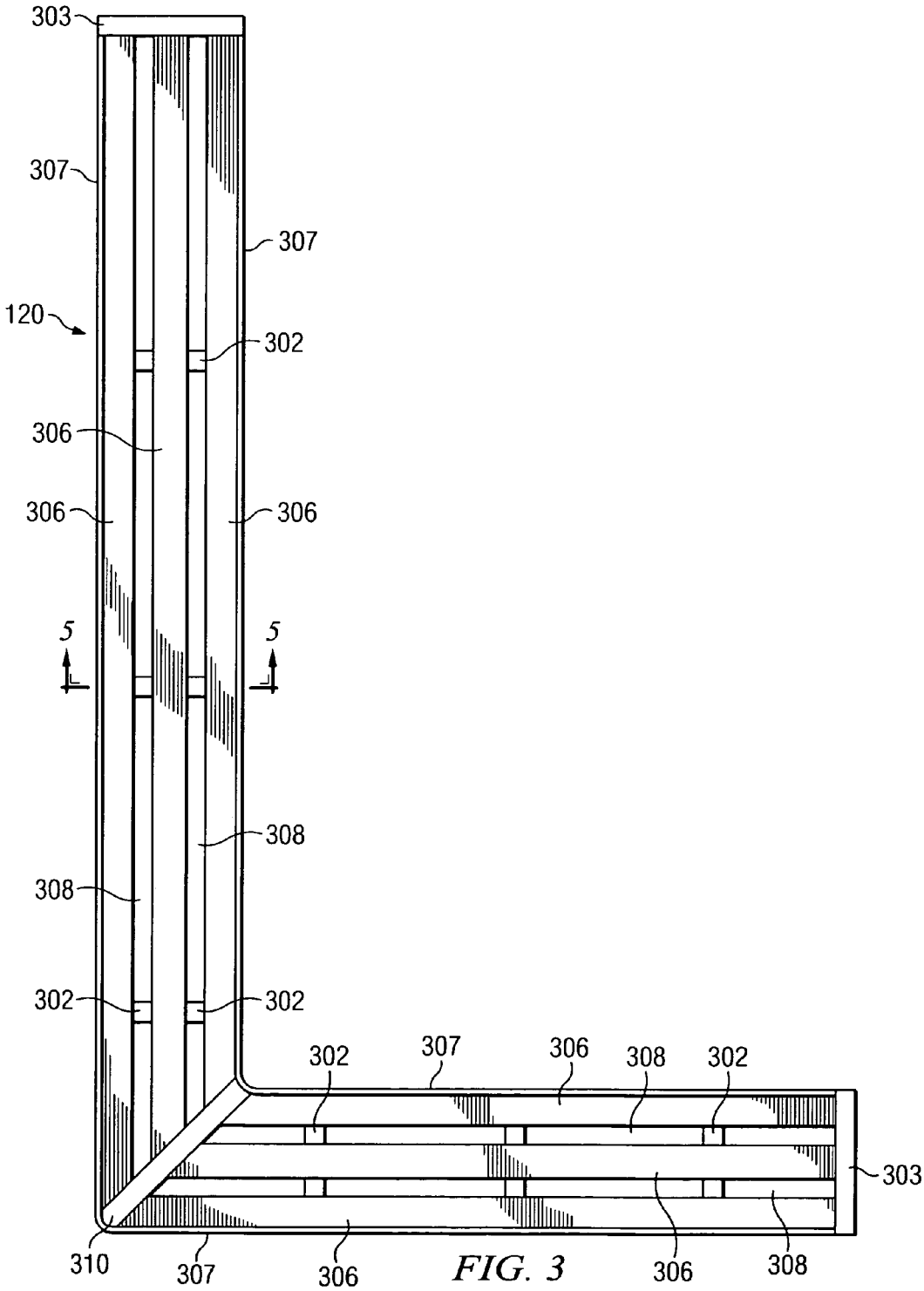
FIG. 3 is a top view of the shelf of FIG. 1.

As shown most clearly in FIG. 3, the ends of the shelf 120 are fitted with end cover caps 303. Referring to FIG. 1, the caps 303 may be configured for being secured to a wall 102 or 114, via, by way of example, adhesive, screws, and/or the like, thereby providing additional support and stability to the shelves 120. Optionally, the end caps 303 may also define a slot, similar to the slot 502, sized for matingly engaging with and receiving the upper edges 117 and 119 (or headpieces fitted thereon) of the walls 116 and 118, respectively, and to thereby provide further support and stability to the shelf 120 supported thereon.

As best shown in FIGS. 3 and 4, the shelf 120 may include an end connector 310 for connecting together ends of slats 306, generally, though not necessarily, having angled end portions. More specifically, the connector 310 is preferably configured to receive, and thereby connect together, angled end portions of the slats 306, which may extend in two different directions. The slats 306 may be secured to the connector 310 via, by way of example, adhesive, screws, and/or the like. In some instances, the end portions of the slats 306 may not be angled, and in other instances, the shelf 120 may consist substantially of a single straight, round, or curvilinear section, depending on the configuration of a particular shower enclosure 110 with which it is used, and thus not require an end connector 310.

The aforementioned component parts of the shelf 120 constituting the decorative accessory for shower enclosures 112 of the present invention may be fabricated from any of a number of different plastics, metals, composites, and the like, and combinations thereof, depending upon the requirements of particular applications of the invention. Materials employed in the fabrication of the shelf 120 are preferably suitable for exposure to water, but if materials are employed which are affected by water, such as wood, certain metals (e.g., iron, aluminum, brass), and the like, then a conventional protective coating is preferably applied to the surface of the material to protect it from water.

Referring again to FIG. 1, the shelf 120 constituting the decorative accessory for the shower enclosure 112 of the present invention may be utilized to support decorative objects such as one or more potted plants 130, decorative pots and statuary, other decorative objects, extra bars of soap, razors, towels, toiletries, and/or the like. In actual practice, the shelf 120 may be utilized in conjunction with trailing plants such as ivy and philodendron which cascade downwardly on the inside and/or outside of the shower enclosure 112, providing a very pleasing effect. It has been found that the moist conditions which typically surround a shower enclosure are highly advantageous to the health of plants utilized in conjunction with the present invention.

It is noted that, in the case of a shower enclosure comprising a shower curtain (not shown) suspended from a shower curtain support rod (not shown), the shelf 120 may be supported from the walls 114 of the shower enclosure 112 and/or from the walls 102 of the room 100 having the shower enclosure 112 installed therein. The shelf 120 then extends substantially parallel to and above the shower curtain, and the slots 502 of the brackets 302 are sized to receive or accommodate the shower curtain support rod and the rings which support the shower curtain on the shower curtain support rod. In an alternate embodiment, the shelf 120 may be configured with a shower curtain support rod integrated therein. In a still further alternate embodiment, the shelf 120 may be configured with two shower curtain support rods integrated therein, one of which is used for an interior shower curtain, the other of which is used for an exterior shower curtain. Two shower curtain support rods would provide additional support between walls, and would also facilitate changing out one curtain at a time.

Figure 7:
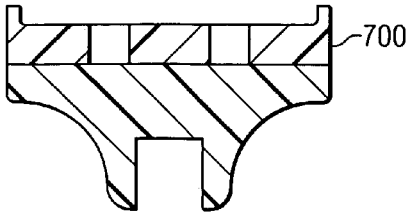

FIG. 7 is a cross-section of a shelf 720 positioned on the bracket 302, in which the shelf 720 comprises slats 706 formed from a single panel of material, and slots 708 are cut out therefrom. The shelf 720 is positioned on and secured to the brackets 302 similarly as the shelf 120 was positioned and secured thereto, discussed above with respect to FIGS. 5 and 6. It may be appreciated that, in many instances, the embodiment depicted with respect to FIG. 7 facilitates streamlined manufacturing. It is noted that the reference numeral 120 will be used hereinafter to refer collectively to the shelves 120 and 700.

Figure 8:
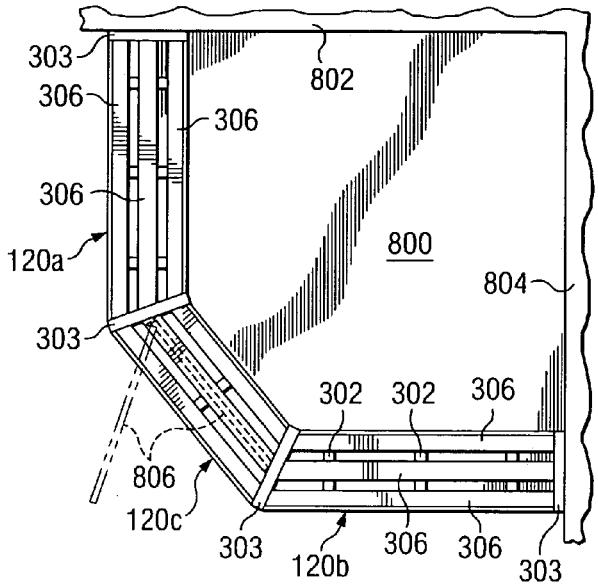
FIGS. 8–10 are top views of the present invention configured on various shower enclosures.

FIG. 8 illustrates an embodiment of the invention, in which a shower enclosure 800 is situated in a corner defined by two orthogonal walls 802 and 804. The shelf 120 of the present invention is configured as three straight discrete sections 120*a*, 120*b*, and 120*c* positioned on upper edges of two opposing sides of the shower enclosure 800 and over a door 806. Two of the end caps 303 adjacent to walls 802 and 804 are preferably secured to the respective walls, as discussed above.

Figure 9:
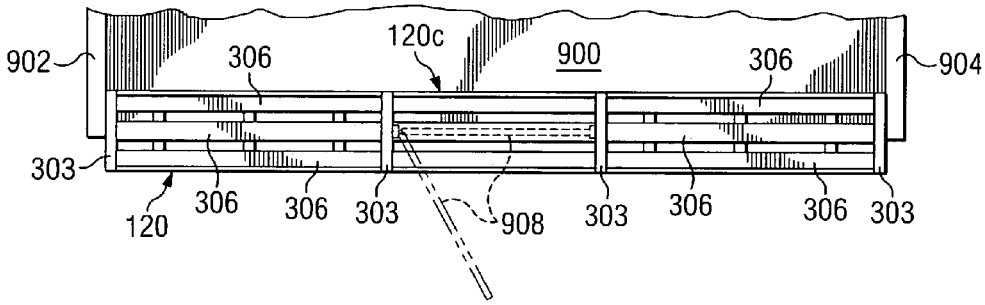

FIG. 9 illustrates an embodiment of the invention in which a shower enclosure 900 is positioned between spaced, substantially parallel walls 902 and 904. The shelf 120 of the present invention is preferably configured as a single section, or alternatively as three discrete sections, that extend across the upper edges 117 and 119 of a door 908 and freestanding walls 910, respectively, of the shower enclosure 900, and that is preferably secured via end caps 303 to the respective walls 902 and 904.

Figure 10:
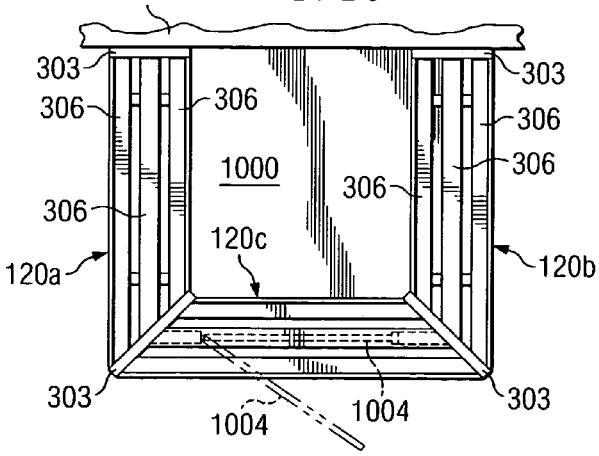

FIG. 10 illustrates an embodiment of the invention in which a shower enclosure 1000 projects outwardly from a wall 1002 and comprises two freestanding walls (not shown) and a door 1004. The shelf 120 of the present invention is preferably configured as three discrete sections 120*a*, 120*b*, and 120*c*, extending over the freestanding walls and door 1004 of the enclosure 1000, and preferably secured via end caps 303 to the wall 1002.

FIG. 11 illustrates an alternate embodiment of the present invention in which a shelf 1100 and brackets 1102 are configured to facilitate slidable mounting of the shelf onto the brackets. Specifically, with reference to FIG. 12, the shelf 1100 preferably includes a support platform portion 1202, lips 1204, and downwardly extending mirrored L-shaped extensions 1206. While not shown, drainage ports may be formed in the platform portion 1202 for facilitating drainage of water that collects on the platform portion 1202. With reference to FIG. 13, the bracket 1102 includes a shelf support surface 1302, a slot 1304 similar to the slot 502 discussed above with respect to FIG. 5, and mirrored L-shaped slots 1306 configured for matingly receiving the extensions 1206 of the shelf 1100. In use, the shelf 1100 is slidably mounted onto two or more brackets 1102 and the brackets are mounted onto upper edges 117 and 119 of a shower enclosure, such as the shower enclosure 112. Once the brackets are so mounted onto upper edges, the shelf 1100 may be slidably adjusted along the bracket 1102 to conform to the dimensions of any particular shower enclosure. By using the shelf 1100 and bracket 1102, the shelf 1100 may be manufactured by an extrusion process, thereby permitting economical gains in manufacturing efficiency.

Figure 14:
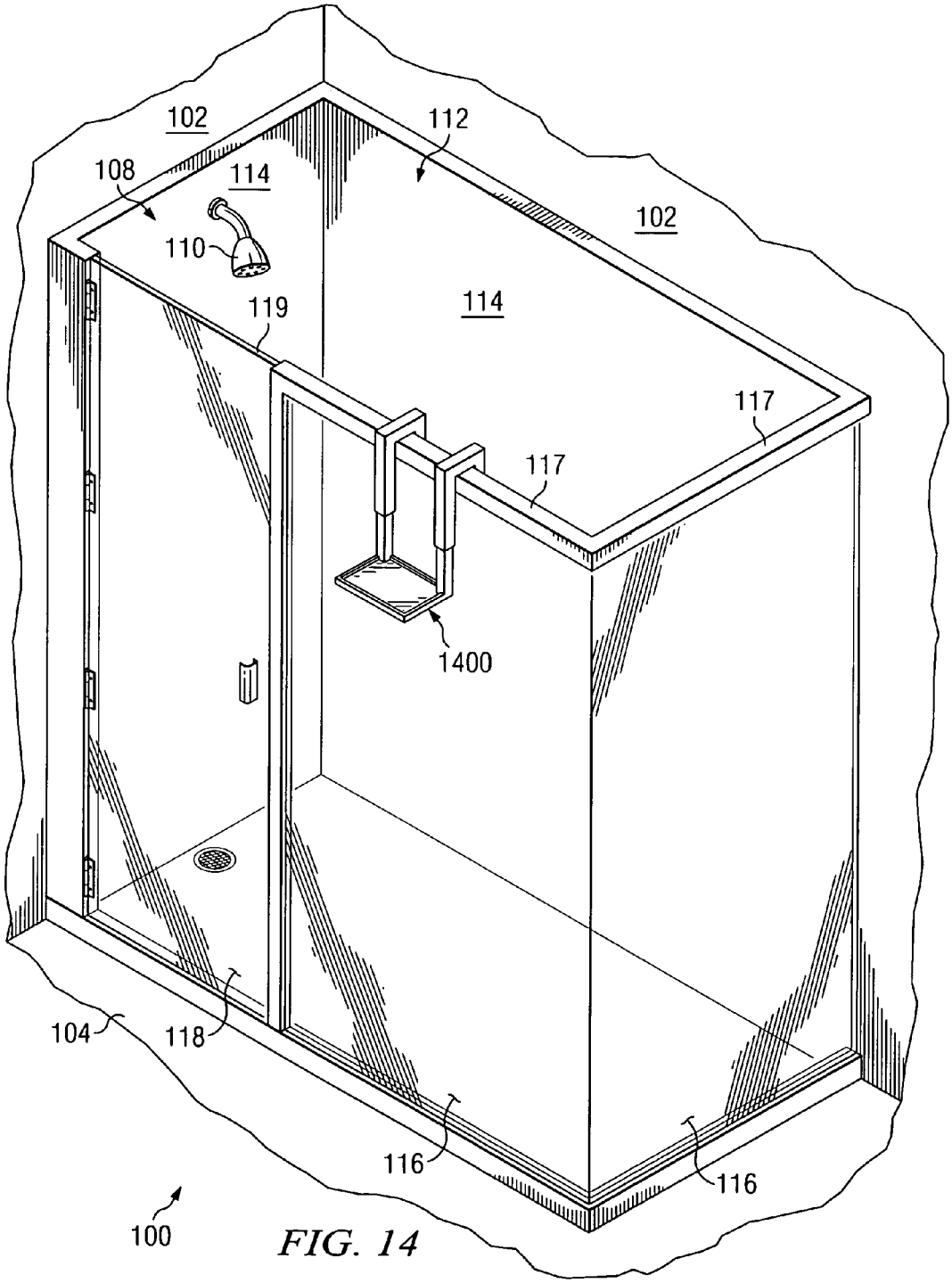
FIGS. 14–17 show an alternate embodiment of the present invention in which a shelf is suspended from an upper edge of a shower enclosure.
Figure 15:
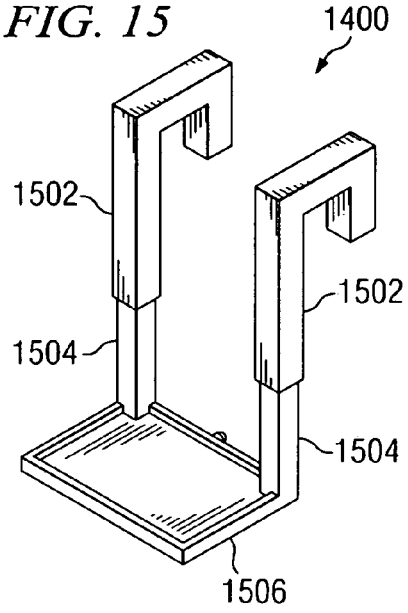
Figure 16:
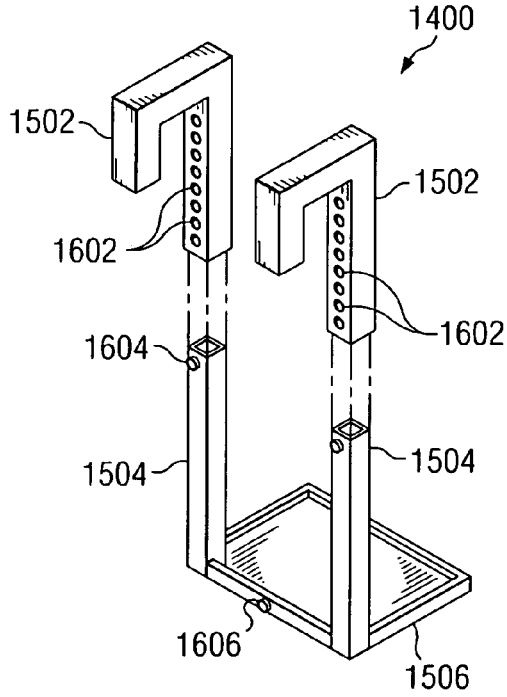
Figure 17:
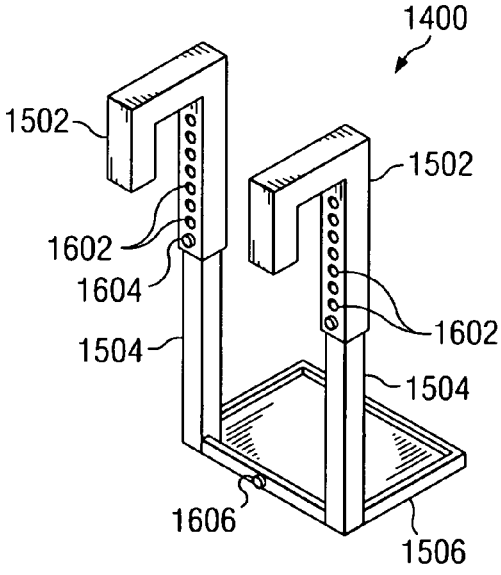

FIG. 14 illustrates the shower enclosure 112 configured with a shelf 1400 suspended from an upper edge 117. As shown more clearly in FIG. 15, the shelf 1400 comprises an upper support arm 1502, a lower support arm 1504, and a shelf 1506 suspended from the lower support arm 1504, all of which are preferably fabricated from materials suitable for exposure to water, such as any of a number of different plastics, metals, composites, and the like, with protective coatings as appropriate, and combinations thereof, depending upon the requirements of particular applications of the invention. The upper support arm 1502 is preferably sized larger than the lower support arm 1504 to enable the upper arm to telescopically receive the lower arm; though, in an alternate embodiment, the lower arm may be sized larger than the upper arm to enable the lower arm to telescopically receive the upper arm. The upper arm 1502 is configured with a hook shape for facilitating suspension of the shelf 1506 from an upper edge 117 or 119 of a shower enclosure 112. As shown in FIG. 16, each of the lower arms 1504 further comprises a detent 1604, and each of the upper arms 1502 define at least one hole 1602 for receiving a respective detent. In operation, the upper arms 1502 are positioned over the lower arms 1504, and the detents 1604 are depressed for allowing the upper arms to receive the lower arms. The detents 1604 are depressed until a selected hole 1602 is positioned over a detent, and the detent is then released to thereby secure the shelf 1506 at a desired height relative to the upper arm 1502, as depicted in FIG. 17, and to an upper edge 117 when the upper arms 1502 are suspended from an upper edge, as depicted in FIG. 14. The shelf 1400 is, preferably, also provided with a rubber or plastic stop 1606 for abutting a wall 116 or 118. It is noted that, while the shelf 1400 is positioned in FIG. 14 on the exterior of the shower enclosure 112, it may readily be positioned on the interior of the shower enclosure. In alternate embodiments, the upper and lower arms may use other techniques, well-known in the art, to facilitate telescopic adjustment, or even use a single non-adjustable arm suitable for replacing both the upper and lower arms.

Figure 18:
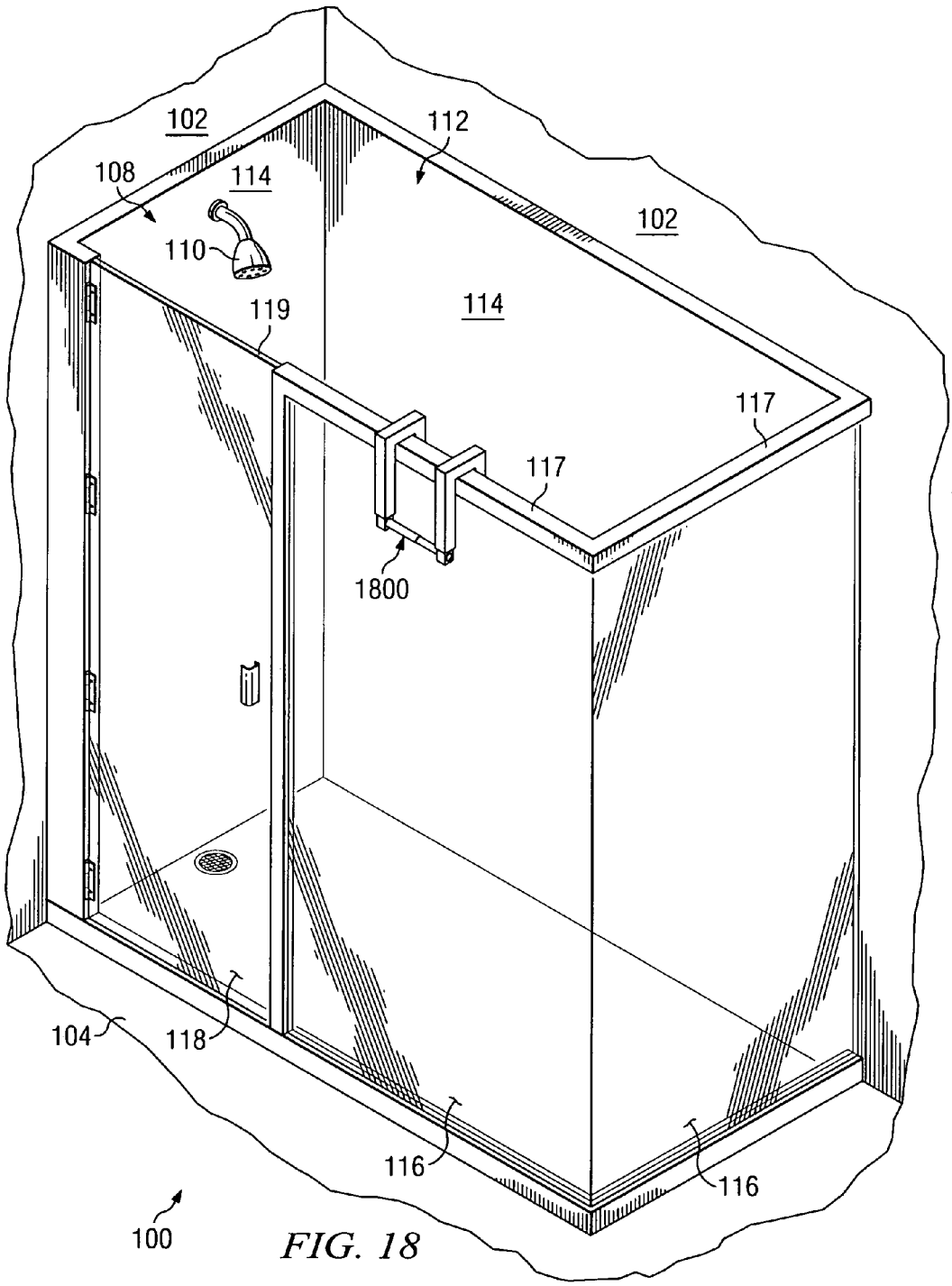
FIGS. 18–19 show an alternate embodiment of the present invention in which a towel rack is suspended from an upper edge of a shower enclosure.
Figure 19:
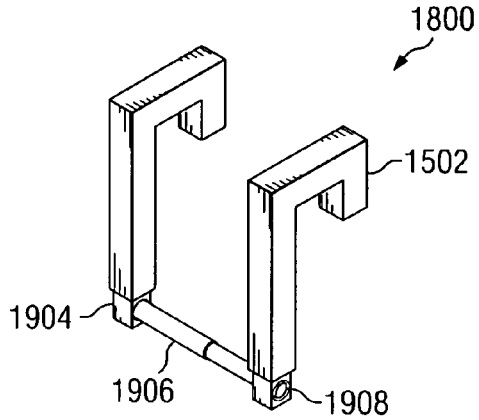

FIGS. 18 and 19 illustrate an alternate embodiment of the shelf 1400 configured as a towel rack 1800, in which the shelf 1506 is replaced with a bar 1906 positioned within bores 1908 defined in the lower support arms 1904 for supporting a towel from an upper edge 117 of the shower enclosure 112. The towel rack 1800 and operation thereof is otherwise identical to the shelf 1400. In further alternate embodiments, one or more shelves 1506 and/or one or more towel rack bars 1906 may be combined in a single unit supported from an upper edge 117 or 119.

Figure 21:
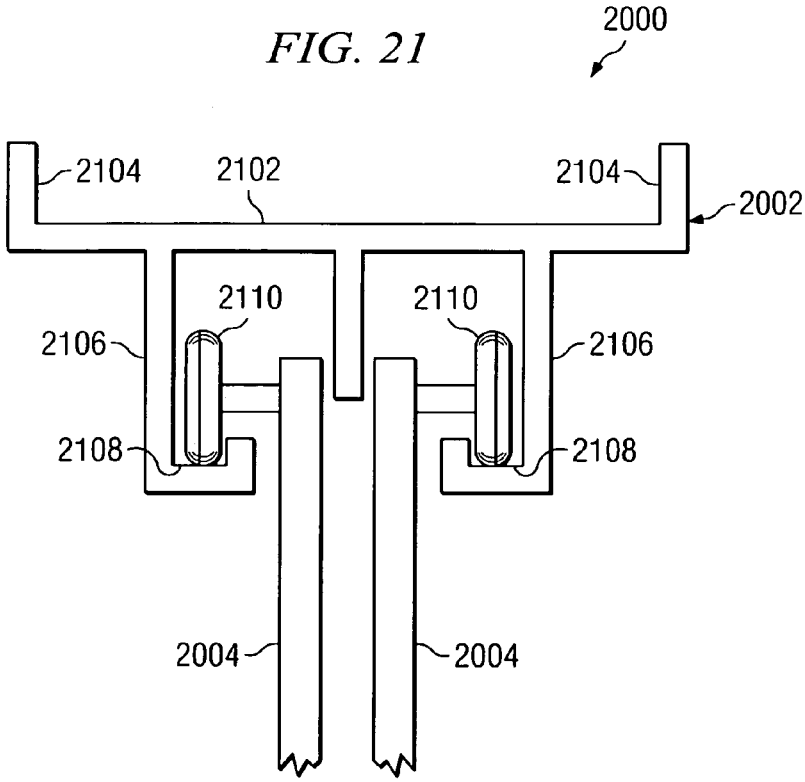
FIGS. 20–21 show an alternate embodiment of the present invention in which doors to a shower enclosure are slidably mounted on a rail integrated into a shelf structure.
Figure 20:
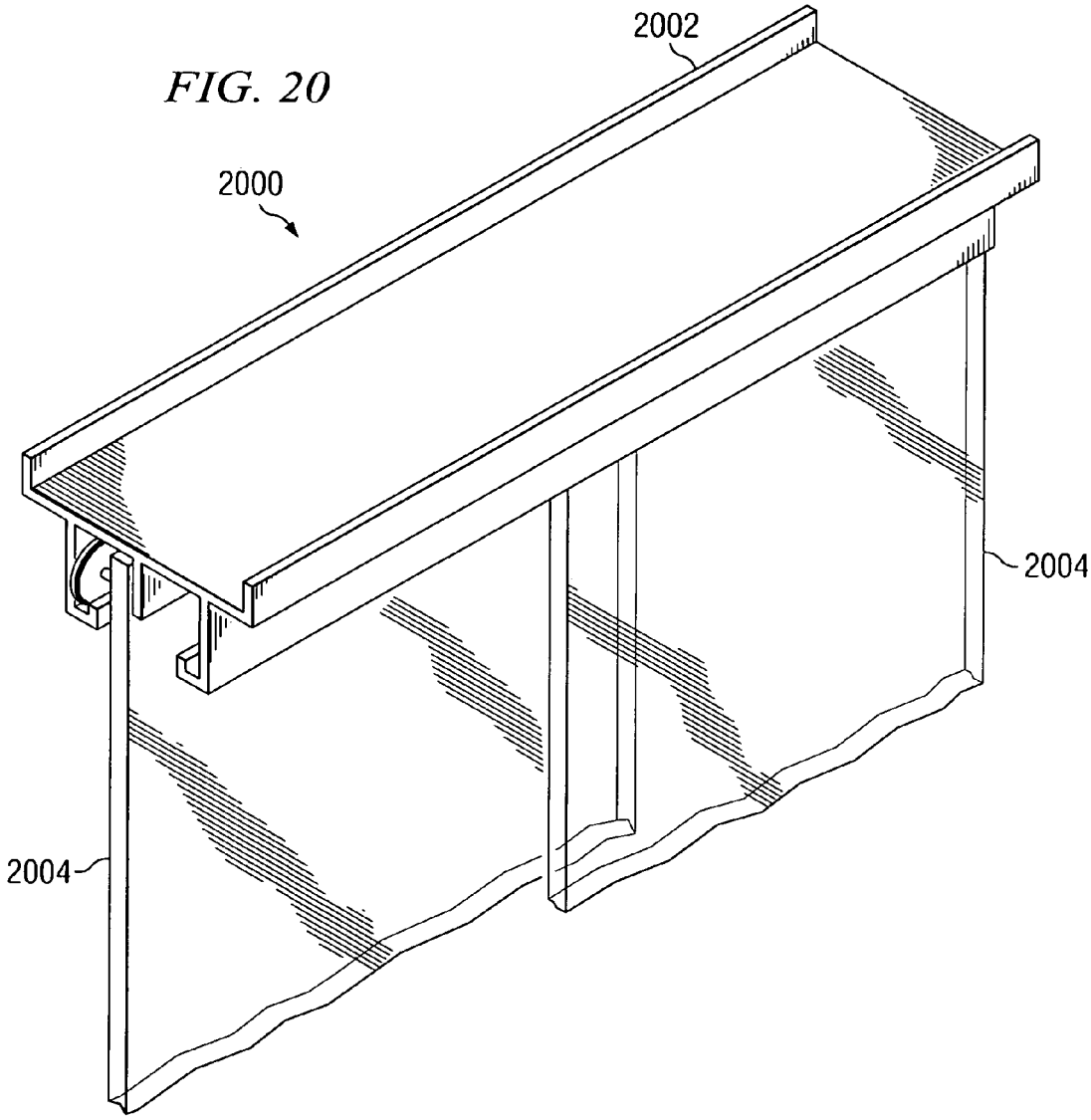

FIG. 20 illustrates an alternate embodiment of the present invention in which a shelf 2000 includes a rail structure 2002 for slidably supporting two doors 2004 configured for providing access to a shower enclosure. As shown more clearly in the cross-section of FIG. 21, the rail structure 2002 includes a support platform portion 2102 having two lips 2104 extending upwardly from each end of the platform portion 2102 thereof. While not shown, drainage ports may be formed in the platform portion 2102 for facilitating drainage of water that collects on the platform portion 2102. The platform portion 2102 further comprises two downwardly extending rails 2106, each of which defines tracks 2108 configured for slidably supporting a door 2004. Each door 2004 includes at least two wheels 2110 (only one of which is depicted for each door in FIG. 21) rotatably mounted to respective doors 2004 for riding along a respective track 2108 of the rails 2106.

The shower enclosures illustrated in FIGS. 1, 2, and 8–10 and described hereinabove in conjunction therewith may include a headpiece which extends a partial length or the entire length of the enclosure, or upper edges 117 and 119 thereof, including any corners therein. In such instances, the shelf 120 of the present invention may also extend the length of the headpiece, including the portion thereof which extends over the door of the enclosure. Alternatively, the shelf 120 may extend along only a portion of such headpiece or upper edge 117 or 119 of a shower enclosure. For example, the shelf 120 may extend along a portion, or the entire length, of the upper edges 117 of the freestanding walls 116, but not along the top 119 of the door 118.

The use of the present invention provides a decorative accessory for a shower and/or tub in which items, such as plants may be placed for aesthetic appeal, and other items that may be used in a shower, but which a user would prefer remain dry until needed, such as extra bars of soap, razors, towels, toiletries, and the like, may be placed.

It is understood that the present invention may take many forms and embodiments. Accordingly, several variations may be made in the foregoing without departing from the spirit or the scope of the invention. For example, a light source, such as a neon light, sealed against water entry, may be positioned under the shelf 120 inside or outside of a shower enclosure 112 to provide "softer" illumination than is available from conventional ceiling lighting. The shelf 120 may also provide a structure through which other electrical accessories, such as a clock, radio, phone, and the like, may be operated, provided same is sealed against water. Electrical power would preferably be supplied via batteries, but alternatively may be supplied via solar power cells or conventional household alternating current (AC). The slats 206 of the shelf 120 may be telescopically extendable to accommodate and adapt- to shower enclosures of different sizes. The slats 206 may be hingedly connected at the connector 303 to facilitate adjustment of the shelf 120 for variously shaped shower enclosures 112.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. An accessory adapted for installation on a shower enclosure defined by a shower head and at least one substantially vertical wall having an upper edge structure higher than said shower head, the accessory comprising:

a plurality of spaced transversely extending brackets disposed apart from each other, each of said plurality of spaced transversely extending brackets having a slot formed on a lower portion thereof, said slots are dimensioned and configured for slidably engaging the top of said upper edge structure and for mounting said accessory on top of said upper edge structure without assistance from additional fastening mechanisms to provide support and stability to said accessory disposed thereon;

at least one inner slat extending longitudinally in a direction across said spaced transversely extending brackets, said at least one inner slat defining a first surface and being detachably mounted on an upper surface of each of said plurality of spaced transversely extending brackets, said first surface having at least a first portion of which is substantially flat; and at least two outer slats extending longitudinally in a direction across said spaced transversely extending brackets, said at least two outer slats removable from said at least one first inner slat, each of said at least two outer slats defining a second surface and being detachably mounted on the upper surface said plurality of spaced transversely extending brackets, said second surfaces having second portions of which are substantially flat, wherein said first portion of at least one inner slat and said second portions of said at least two outer slats are substantially co-planar, said at least two outer slats having lips for retaining items placed on said first portion and second portions;

wherein said at least one inner slat and said at least two outer slats are spaced apart to define through slots between the slats for facilitating drainage.

2. The accessory of claim 1, further comprising a decorative item positioned on said accessory.

3. The accessory of claim 1, further comprising a decorative item positioned on said accessory, said decorative item comprising at least one of potted plants, decorative pots, statuary.

4. The accessory of claim 1, further comprising a shower item positioned on said accessory.

5. The accessory of claim 1, further comprising a shower item positioned on said accessory, said shower item comprising at least one of soap, shampoo, towels, and toiletries.

6. The accessory of claim 1, wherein said at least two brackets are spaced apart in a longitudinal direction.

7. The accessory of claim 1, wherein said at least one first slat and said at least one second slat are detachably mounted via threaded fasteners to said at least two brackets.

8. An accessory adapted for installation on a shower enclosure having a shower head and an upper edge structure higher than said shower head, the accessory comprising:

a plurality of spaced transversely extending brackets disposed apart from each other, each of said plurality of spaced transversely extending brackets having a slot formed on a lower portion thereof, said slots are dimensioned and configured for slidably engaging the top of said upper edge structure and for mounting said accessory on top of said upper edge structure without assistance from additional fastening mechanisms to provide support and stability to said accessory disposed thereon;

at least one inner slat extending longitudinally in a direction across said spaced transversely extending brackets, said at least one inner slat defining a first surface and being detachably mounted on an upper surface of each of said plurality of spaced transversely extending brackets, said first surface having at least a first portion of which is substantially flat; and at least two outer slats extending longitudinally in a direction across said spaced transversely extending brackets, said at least two outer slats removable from said at least one first inner slat, each of said at least two outer slats defining a second surface and being detachably mounted on the upper surface said plurality of spaced transversely extending brackets, said second surfaces having second portions of which are substantially flat, wherein said first portion of at least one inner slat and said second portions of said at least two outer slats are substantially co-planar, said at least two outer slats having lips for retaining items placed on said first portion and second portions;

wherein said at least one inner slat and said at least two outer slats are spaced apart to define through slots between the slats for facilitating drainage.

9. The accessory of claim 8, further comprising a decorative item positioned on said accessory.

10. The accessory of claim 8, further comprising a decorative item positioned on said accessory, said decorative item comprising at least one of potted plants, decorative pots, statuary.

11. The accessory of claim 8, further comprising a shower item positioned on said accessory.

12. The accessory of claim 8, further comprising a shower item positioned on said accessory, said shower item comprising at least one of soap, shampoo, towels, and toiletries.

13. The accessory of claim 8, wherein said at least one first slat and said at least one second slat are detachably mounted via threaded fasteners to said at least two brackets.

14. A method for supporting at least one of a decorative item and a shower item, the method comprising steps of:

installing an accessory on a shower enclosure defined by a shower head and at least one substantially vertical wall having an upper edge structure higher than said shower head, the accessory including:

a plurality of spaced transversely extending brackets disposed apart from each other, each of said plurality of spaced transversely extending brackets having a slot formed on a lower portion thereof, said slots are dimensioned and configured for slidably engaging the top of said upper edge structure and for mounting said accessory on top of said upper edge structure without assistance from additional fastening mechanisms to provide support and stability to said accessory disposed thereon;

at least one inner slat extending longitudinally in a direction across said spaced transversely extending brackets, said at least one inner slat defining a first surface and being detachably mounted on an upper surface of each of said plurality of spaced transversely extending brackets, said first surface having at least a first portion of which is substantially flat; and at least two outer slats extending longitudinally in a direction across said spaced transversely extending brackets, said at least two outer slats removable from said at least one first inner slat, each of said at least two outer slats defining a second surface and being detachably mounted on the upper surface said plurality of spaced transversely extending brackets, said second surfaces having second portions of which are substantially flat, wherein said first portion of at least one inner slat and said second portions of said at least two outer slats are substantially co-planar, said at least two outer slats having lips for retaining items placed on said first portion and second portions;

wherein said at least one inner slat and said at least two outer slats are spaced apart to define through slots between the slats for facilitating drainage; positioning at least one of said decorative item and said shower item on said accessory.

15. The method of claim 14, wherein said decorative item comprises at least one of potted plants, decorative pots, and statuary.

16. The method of claim 14, wherein said shower item comprises at least one of soap, shampoo, towels, and toiletries.

17. The method of claim 14, wherein said at least two brackets are spaced apart in a longitudinal direction.

18. The method of claim 14, wherein said at least one first slat and said at least one second slat are detachably mounted via threaded fasteners to said at least two brackets.

* * * * *

UNITED STATES PATENT AND TRADEMARK OFFICE

CERTIFICATE OF CORRECTION

PATENT NO. : 7,096,519 B2
APPLICATION NO. : 10/411068
DATED : August 29, 2006
INVENTOR(S) : Susan Ferreri and William K. Hunter It is certified that error appears in the above-identified patent and that said Letters Patent is hereby corrected as shown below:

Title Page, Item (75) should read:

Inventors: Susan Ferreri, P.O. Box 113362, Carrollton, TX (US) 75011-3363, William K. Hunter, Midlothian, TX (US)

Signed and Sealed this

Ninth Day of January, 2007

JON W. DUDAS
*Director of the United States Patent and Trademark Office*